United States Patent [19]
Flanagan et al.
[11] 4,373,976
[45] Feb. 15, 1983

[54] GUN PROPELLANT CONTAINING NITROAMINOGUANIDINE

[75] Inventors: Joseph E. Flanagan, Woodland Hills; Vernon E. Haury, Simi, both of Calif.

[73] Assignee: Rockwell International Corporation, El Segundo, Calif.

[21] Appl. No.: 775,823

[22] Filed: Mar. 9, 1977

[51] Int. Cl.[3] ..... C06B 25/34
[52] U.S. Cl. ..... 149/92; 149/96; 149/100
[58] Field of Search ..... 149/88, 92, 96, 100

[56] References Cited

U.S. PATENT DOCUMENTS 3,909,322 9/1975 Chang et al. ..... 149/92 X
3,940,298 2/1976 Beckert et al. ..... 149/92

*Primary Examiner*—Stephen J. Lechert, Jr.
*Attorney, Agent, or Firm*—H. Fredrick Hamann; Harry B. Field

[57] ABSTRACT

A family of gun propellants formulated with nitroaminoguanidine (NAGU), as an oxidizer, to reduce the isochoric flame temperature while providing high mass impetus.

1 Claim, No Drawings

GUN PROPELLANT CONTAINING NITROAMINOGUANIDINE

BACKGROUND OF THE INVENTION

1. Field of the Invention

This invention relates to gun propellants and is particularly directed to gun propellant formulations employing nitroaminoguanidine as an oxidizer, to provide low isochoric flame temperatures and high mass impetus.

2. Description of the Prior Art

For several hundred years, investigators have been seeking to improve firearms and the propellants used in them. Many significant improvements have been made. However, as long as there is a demand for such weapons, the search for improvements will continue. In recent years, automatic guns have been developed which are capable of firing several thousand rounds of ammunition per minute. However, the gun propellants available heretofore have had isochoric flame temperatures in the range of 2400° K. to 3300° K. As a result, the barrels of the automatic guns have tended to overheat and become warped quite rapidly. Consequently, it has been necessary to replace the gun barrels frequently, which reduces the effectiveness of such guns and adds considerably to the expense of operating such guns. While some prior art gun propellants are known which have lower flame temperatures, these cool-burning propellants generally also have significantly lower mass impetus.

BRIEF SUMMARY AND OBJECTS OF THE INVENTION

These disadvantages of the prior art are overcome with the present invention and a family of gun propellants is proposed which provides isochoric flame temperatures 20 to 30 percent lower than those of conventional military propellants, while yielding comparable or higher mass impetus.

The advantages of the present invention are preferably attained by providing gun propellant formulations employing nitroaminoguanidine (NAGU) as an oxidizer.

Accordingly, it is an object of the present invention to provide improved gun propellants.

Another object of the present invention is to provide gun propellants having flame temperatures which are significantly lower than those of conventional military propellants, while yielding comparable or greater mass impetus.

A specific object of the present invention is to provide gun propellant formulations employing NAGU as an oxidizer.

These and other objects and features of the present invention will be apparent from the following detailed description.

DETAILED DESCRIPTION OF THE INVENTION

In that form of the present invention chosen for purposes of illustration, a family of gun propellants is formulated, employing NAGU as an oxidizer, to provide flame temperatures which are significantly lower than those of conventional military propellants, while yielding comparable or greater mass impetus.

The theoretical performances of standard military propellants, as described in U.S. Army Propellant Manual No. AMCP-706-150, published February 1965, are shown in Table I.

TABLE I

| Propellant | Mass Impetus ft-lb/lb | Flame Temperature | Molecular Weight |
|---|---|---|---|
| M-1 | 305,000 | 2417° K. | 22.06 |
| M-2 | 360,000 | 3319° K. | 25.64 |
| M-10 | 339,000 | 3000° K. | 24.58 |
| IMR | 325,000 | 2827° K. | 24.17 |

In contrast, propellants formulated with NAGU have yielded mass impetus in the range of 310,000 to 370,000, with flame temperatures in the range of 2100° K. to 2700° K.

EXAMPLE I

A gun propellant containing 70% by weight of NAGU, 10% by weight of cyclotetramethylene tetranitramine (HMX), 17.5% by weight of nitrocellulose (12.6% N), and 2.5% by weight triacetin. This propellant had a molecular weight of 20.7 and when fired in a 20 mm Mann gun, yielded the data shown in Table II.

TABLE II

| | |
|---|---|
| Charge Weight | 62.0 grams |
| Grain Dimensions (inches) | 0.500 × .180 × .010 |
| Peak Pressure | 50,500 psi |
| Muzzle Velocity | 3840 ft/sec |
| Isochoric Flame Temperature | 2675° K. |
| Mass Impetus | 370,500 ft-lbs/lb |

EXAMPLE II

A gun propellant was formulated consisting of 50% by weight of NAGU, 20% by weight of cyclotetramethylene tetranitramine, 25% by weight of nitrocellulose, and 5% by weight of isodecylpelarganate (IDP). This propellant yielded an isochoric flame temperature of 2607° K., a mass impetus of 360,500 ft-lb/lb and a molecular weight of 20.1. After seven days storage at 75° C., no degradation of the propellant was observed.

EXAMPLE III

A gun propellant was formulated consisting of 60% by weight of NAGU, 10% by weight of cyclotetramethylene tetranitramine, 20% by weight of nitrocellulose, and 10% by weight of IDP. This yielded an isochoric flame temperature of 2102° K., a mass impetus of 310,400 ft-lb/lbs, and a molecular weight of 18.84.

A technique for producing NAGU is disclosed in the Journal of American Chemical Society Volume 73, p. 474 (1951). Obviously, numerous variations and modifications may be made without departing from the present invention. Accordingly, it should be clearly understood that the forms of the present invention described above are illustrative only and are not intended to limit the scope of the present invention.

We claim:

1. A gun propellant comprising:

Nitroaminoguanidine—50–80 percent

Nitrocellulose (12.6% N)—15–40 percent

Cyclotetramethylene tetranitramine—0–30 percent

Inert Plasticizer triacetin or isodecylpelarganate—0–15 percent.

* * * * *